US010737371B2

(12) United States Patent
Watson et al.

(10) Patent No.: US 10,737,371 B2
(45) Date of Patent: Aug. 11, 2020

(54) SPRINKLER WRENCH PROTECTIVE COVER

(71) Applicant: The Viking Corporation, Hastings, MI (US)

(72) Inventors: Jason Watson, Hastings, MI (US); Shawn G. Orr, Grand Rapids, MI (US); Lindsay M. Barker, Delton, MI (US); Scott T. Franson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 380 days.

(21) Appl. No.: 14/290,440

(22) Filed: May 29, 2014

(65) Prior Publication Data

US 2015/0075334 A1 Mar. 19, 2015

Related U.S. Application Data

(60) Provisional application No. 61/879,838, filed on Sep. 19, 2013.

(51) Int. Cl.

| | |
|---|---|
| ***B25B 13/50*** | (2006.01) |
| ***B25B 13/58*** | (2006.01) |
| ***B25B 13/48*** | (2006.01) |
| ***B25B 13/08*** | (2006.01) |

(52) U.S. Cl.
CPC ..... *B25B 13/50* (2013.01); *B25B 13/08* (2013.01); *B25B 13/481* (2013.01)

(58) Field of Classification Search
CPC ..... B25B 13/50; B25B 13/08; B25B 13/481
USPC ..... 81/186, 124.2, 176.15
See application file for complete search history.

(56) References Cited

U.S. PATENT DOCUMENTS

| | | | | | |
|---|---|---|---|---|---|
| 1,181,565 | A * | 5/1916 | Block | B25B 13/48 | 251/288 |
| 1,434,401 | A | 11/1922 | Mueller | | |
| 1,761,180 | A | 6/1930 | Cave | | |
| 2,714,321 | A | 8/1955 | Tamplin | | |
| 2,766,649 | A | 10/1956 | Labry, Jr. | | |
| 3,030,840 | A * | 4/1962 | South | A62C 37/20 | 81/119 |
| 3,259,000 | A * | 7/1966 | Lasch, Sr. | B25B 13/48 | 81/176.15 |
| 4,096,621 | A * | 6/1978 | Berger | B25B 23/00 | 29/525.05 |
| D274,881 | S * | 7/1984 | Wilsey | D8/29 | |
| 4,905,550 | A | 3/1990 | Albrecht | | |
| 5,988,616 | A * | 11/1999 | Fuller | B25B 5/163 | 269/147 |

(Continued)

FOREIGN PATENT DOCUMENTS

EP 1690635 A2 8/2006

*Primary Examiner* — Brian D Keller
(74) *Attorney, Agent, or Firm* — Harness, Dickey & Pierce, P.L.C.

(57) ABSTRACT

A sprinkler wrench for installing a sprinkler includes a base having a tool engaging portion. A sidewall extends from the base and a sprinkler engaging portion extends from the sidewall. The sprinkler engaging portion includes a pair of oppositely facing surfaces defining an outer perimeter and a recess including two opposing flats. A protective boot cover is removably attached to the sprinkler engaging portion and includes flat cover portions covering the two opposing flats.

1 Claim, 3 Drawing Sheets

(56) References Cited

U.S. PATENT DOCUMENTS

| | | | | |
|---|---|---|---|---|
| 6,062,110 | A * | 5/2000 | Julio | B25B 13/48 81/124.2 |
| D426,438 | S * | 6/2000 | Ciok | D8/29 |
| 6,339,980 | B1 * | 1/2002 | Woolf | B25B 23/00 81/185 |
| 6,360,634 | B1 * | 3/2002 | Leitch | B23B 31/006 81/124.2 |
| 6,487,942 | B1 | 12/2002 | Carter et al. | |
| 7,055,614 | B1 | 6/2006 | Ide | |
| 7,185,567 | B2 * | 3/2007 | Ide | B25B 13/50 81/124.2 |
| 9,770,812 | B2 | 9/2017 | Jefferson | |
| 2004/0255735 | A1 | 12/2004 | Sahag et al. | |
| 2007/0095936 | A1 * | 5/2007 | Ungerecht | B05B 15/16 239/288.3 |
| 2013/0020406 | A1 | 1/2013 | Koiwa | |
| 2013/0239760 | A1 * | 9/2013 | Lucas | B25B 5/163 81/421 |

* cited by examiner

SPRINKLER WRENCH PROTECTIVE COVER

CROSS-REFERENCE TO RELATED APPLICATIONS

This application claims the benefit of U.S. Provisional Application No. 61/879,838, filed on Sep. 19, 2013. The entire disclosure of the above application is incorporated herein by reference.

FIELD

The present disclosure relates to a wrench for installing fire protection sprinklers and more particularly, to a protective cover for a sprinkler wrench.

BACKGROUND

This section provides background information related to the present disclosure which is not necessarily prior art.

Coated fire sprinklers are installed where the desire for matching color of the sprinkler and the surrounding area is wanted. Sprinklers are typically installed with a special wrench that is designed to turn the sprinkler into the fitting by two flat areas on the wrench mating with the two flat areas on the sprinkler frame. When these two areas meet, the torque that is applied often times will allow the wrench to have only a small point contact on the sprinkler frame. This small point contact along with the thin coating on the sprinkler allows the coating of the sprinkler to become marred or scratched.

SUMMARY

This section provides a general summary of the disclosure, and is not a comprehensive disclosure of its full scope or all of its features.

During the installation of coated fire sprinklers the current wrenches that are used often times will mar or scratch the coating that is on the sprinkler. In order to avoid this marring and scratching a sprinkler wrench protective cover boot has been developed to prevent this from happening. This cover slips onto the sprinkler wrench and protects the coated sprinkler from being marred or scratched during the installation process. The cover can be replaced when it becomes worn.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
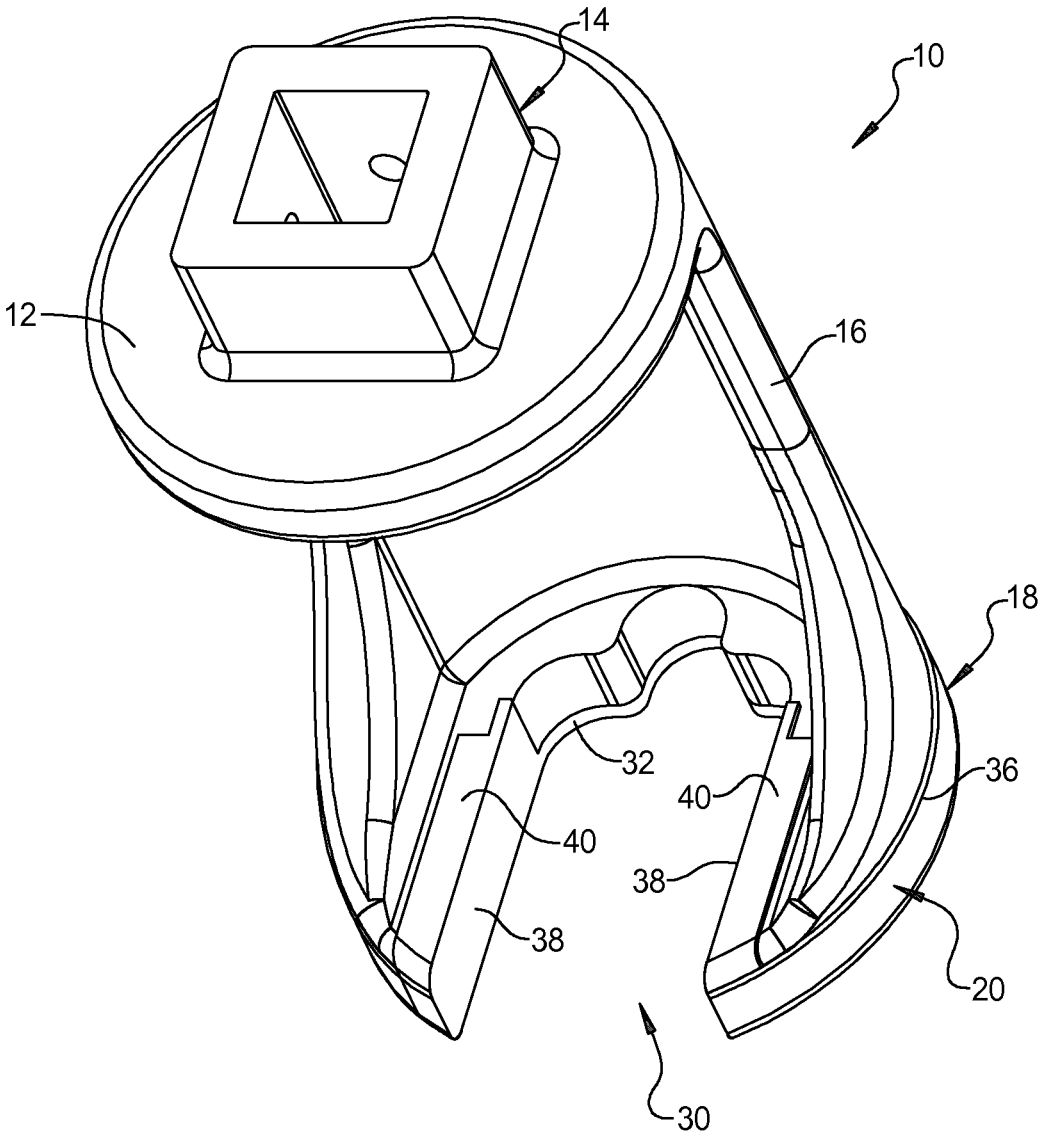
FIG. 1 is a perspective view of a sprinkler wrench with a protective cover according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a sprinkler wrench 10 according to the principles of the present disclosure will now be described. The sprinkler wrench 10 includes a base 12 having a tool engaging portion 14. A longitudinally extending sidewall 16 extends from the base 12 and a sprinkler engaging portion 18 is provided at an opposite end of the sidewall 16. The sprinkler engaging portion 18 is covered with a protective cover boot 20.

Figure 2:
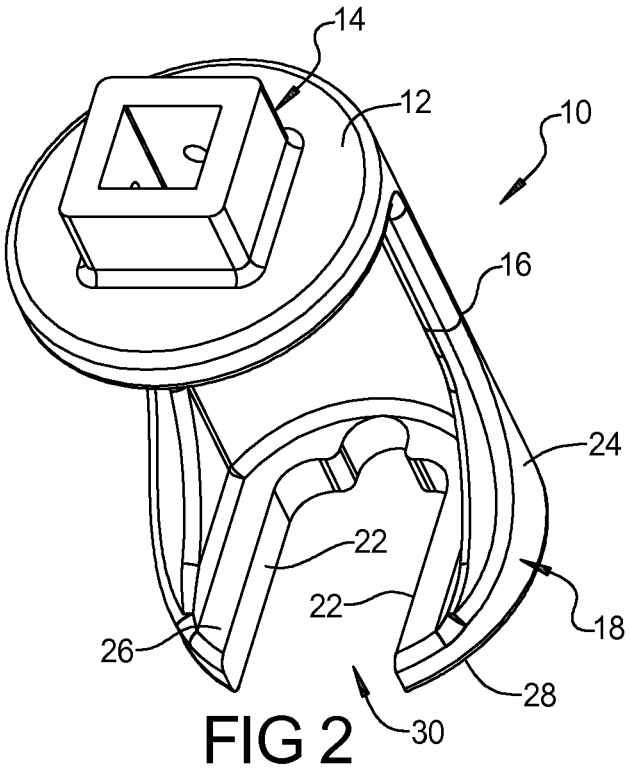
FIG. 2 is a perspective view of the sprinkler wrench of FIG. 1 with the protective cover removed.
Figure 3:
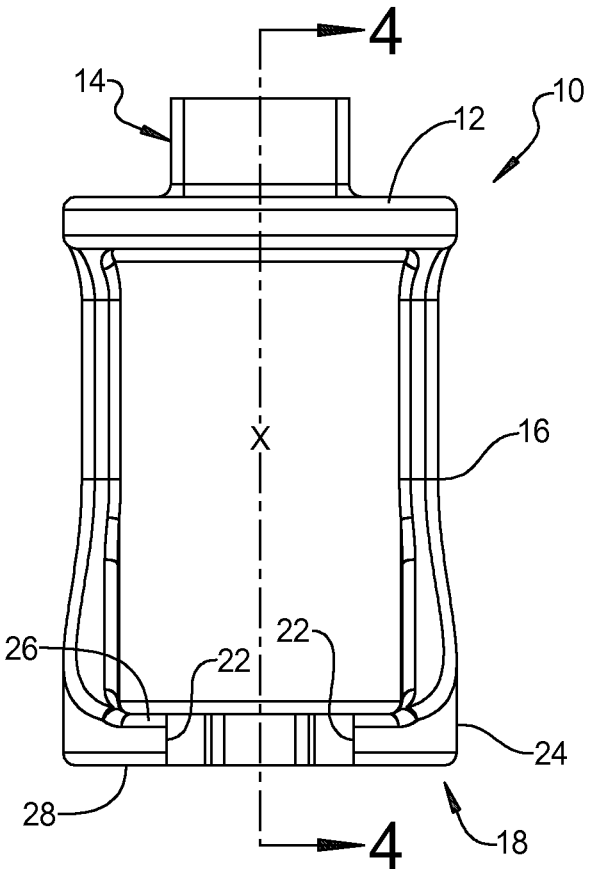
FIG. 3 is a side plan view of the sprinkler wrench of FIG. 1.
Figure 4:
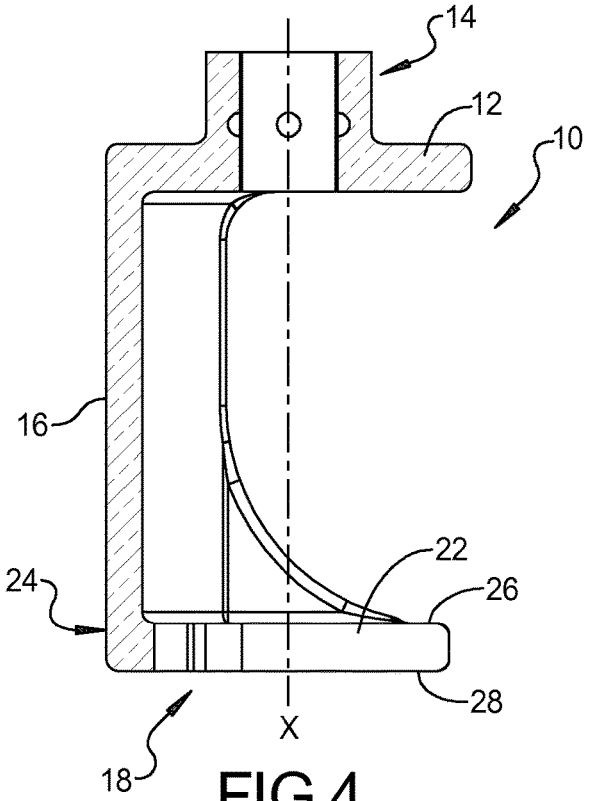
FIG. 4 is a cross-sectional view of the sprinkler wrench taken along line 4-4 of FIG. 3.

With reference to FIGS. 2-4, the sprinkler wrench 10 is shown with the protective cover boot 20 removed for illustration purposes. The sprinkler wrench 10 is made from metal. The tool engaging portion 14 can be provided with a polygonal shape to receive or connect to a tool. The sprinkler engaging portion 18 includes two generally parallel flat areas 22 which are used to engage a tool engaging portion of a sprinkler (not shown). The sprinkler engaging portion 18 can have an outer perimeter surface 24 that is round or can have other shapes. The sprinkler engaging portion 18 can have generally flat oppositely facing surfaces 26, 28 on opposite sides of the flat areas 22 and on opposite sides of the perimeter surface 24. The flat areas 22 define a recess 30 within the oppositely facing surfaces 26, 28 of the sprinkler engaging portion 18. The sprinkler engaging portion 18 is spaced from the base 12 by a distance sufficient to receive the sprinkler frame arms and deflector therebetween. In addition, the sidewall 16 is spaced from a center axis (X) of the wrench 10 to accommodate a sprinkler body and deflector between the base 12 and spring for engaging portion 18.

Figure 5:
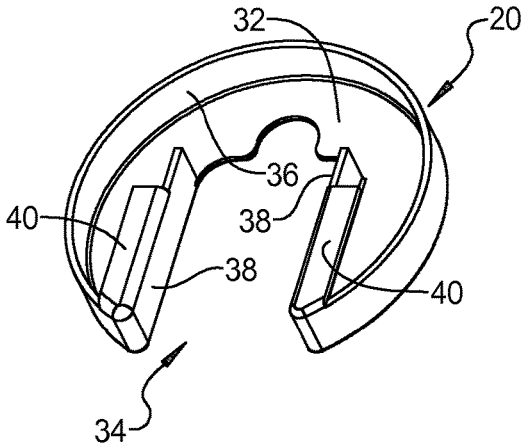
FIG. 5 is a perspective view of a sprinkler wrench cover boot according to the principles of the present disclosure.
Figure 6:
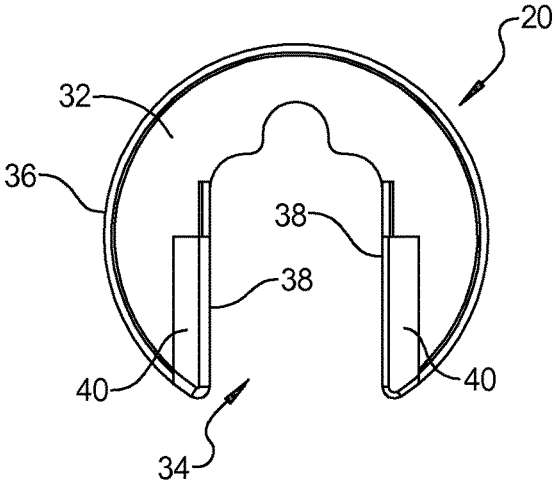
FIG. 6 is a top plan view of the sprinkler wrench cover boot shown in FIG. 5.

As shown in FIGS. 5 and 6, the protective cover boot 20 can include an end face surface 32 that can generally match a shape of the end flat surface 28 of the sprinkler engaging portion 18. The end face surface 32 can include a recess portion 34 that generally matches the shape of the recess 30 in the sprinkler engaging portion 18. A flange portion 36 extends generally perpendicularly from an outer perimeter of the end face surface 32 and a pair of flat cover portions 38 extend from the sides of the recess portion 34. A pair of capture flanges 40 can extend from an upper portion of the pair of flat cover portions 36.

The protective cover boot 20 can be made from a flexible and loadbearing material such as rubber, silicone or other elastomeric or thermoplastic material. The protective cover boot 20 easily slips over the metal sprinkler wrench 10 and can be used for several coated sprinkler installations. The protective cover boot 20 stays on the wrench 10 during installation, but is easily removed if needed and another cover boot 20 can be put on the wrench 10 when the cover boot 20 becomes worn. The protective cover boot 20 is flexible enough that the flange portion 36 can be flexed to engage the perimeter 24 of the sprinkler engaging portion 28 while the flat cover portions 38 and the capture flange 40 can be flexed to engage the flats 22. As shown in FIG. 1, the capture flange 40 secures the protective cover boot 20 to the sprinkler engaging portion 18 during use. The protective cover boot 20 provides protection against marring and scratching of a coating that is on the sprinkler during installation.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fire protection sprinkler installation system, comprising:

a fire protection sprinkler having a sprinkler body having a pair of parallel tool engaging flats and including frame arms and a deflector mounted to the frame arms; and a fire protection sprinkler wrench including:

a base including a polygonal tool engaging portion disposed along an axis of rotation of the fire protection sprinkler wrench;

a sidewall having a proximal end extending from the base in a first axial direction and spaced radially from the axis of rotation by a distance sufficient to accommodate the sprinkler body and the deflector of the fire protection sprinkler;

a fire protection sprinkler engaging portion extending radially inward from a distal end of the sidewall and spaced from the base in the first axial direction by a distance sufficient to receive the fire protection sprinkler's frame arms and deflector therebetween, said fire protection sprinkler engaging portion including an axial end surface and an oppositely facing surface that define an outer perimeter and a radially inwardly extending recess including two parallel opposing flat surfaces extending radially inward from the outer perimeter and spaced apart sufficiently to receive the pair of parallel tool engaging flats of the sprinkler body; and a protective cover boot made from one of a rubber, silicone, elastomeric or thermoplastic material and removably attached to the fire protection sprinkler engaging portion and including a pair of flat cover portions covering said two parallel opposing flat surfaces and a face surface connected to the pair of flat cover portions, the face surface covering an end surface of said fire protection sprinkler engaging portion, the protective cover boot further including a flange portion extending from an outer perimeter of said face surface and surrounding an outer peripheral surface of the fire protection sprinkler engaging portion and a pair of capture flanges extending from said flat cover portions and opposing the face surface, the pair of capture flanges including end portions extending from the flange portion and side edges extending only partly toward the flange portion.

* * * * *